US007368651B2

(12) United States Patent
Duke

(10) Patent No.: US 7,368,651 B2
(45) Date of Patent: May 6, 2008

(54) DIGITAL PULSING VISUAL METRONOME

(76) Inventor: Gary Duke, 46 Salt Creek Avenue, Richmond Hill, Ontario (CA) L4S 1P7

( * ) Notice: Subject to any disclaimer, the term of this patent is extended or adjusted under 35 U.S.C. 154(b) by 260 days.

(21) Appl. No.: 11/169,627

(22) Filed: Jun. 30, 2005

(65) Prior Publication Data

US 2006/0054003 A1 Mar. 16, 2006

Related U.S. Application Data

(60) Provisional application No. 60/609,231, filed on Sep. 13, 2004.

(51) Int. Cl.
*A63J 17/00* (2006.01)

(52) U.S. Cl. ..... 84/464 R; 84/477 R

(58) Field of Classification Search ..... 84/464 R, 84/478, 484, 477 R; D10/43
See application file for complete search history.

(56) References Cited

U.S. PATENT DOCUMENTS 5,005,459 A * 4/1991 Adachi et al. ..... 84/453
6,201,769 B1 * 3/2001 Lewis ..... 368/10
6,859,530 B1 * 2/2005 Terada et al. ..... 379/374.01

* cited by examiner

*Primary Examiner*—Lincoln Donovan
*Assistant Examiner*—Jianchun Qin

(57) ABSTRACT

The visual metronome provides an effective visual tempo signal that is easily discerned by a user without being dominating or harmful. Preferably a user will position the metronome to one side of the center of his expected line of site. The metronome visible within a user's peripheral vision uses an inversing dominant pattern producing two visual states. Each visual state is maintained for one beat of the beat per minute rate set by a user. Each visual state includes a light region and a dark region of similar size and a preferred dominant pattern includes a four region checkerboard pattern.

17 Claims, 6 Drawing Sheets

DIGITAL PULSING VISUAL METRONOME

REFERENCE TO PRIOR APPLICATIONS

This application claims the benefit of U.S. Provisional Application 60/609,231, filed Sep. 13, 2004.

FIELD OF THE INVENTION

The present invention relates to metronomes and in particular, relates to a metronome having a visual display of the tempo that is easily recognized.

BACKGROUND OF THE INVENTION

Metronomes have been commonly used to assist musicians in developing skills with respect to timing and rhythm and are used to assist in coordinating a group of musicians to stay in time. In many musical groups it is the drummer who sets the beat and the remaining members of the group merely follow the set beat.

Metronomes can be generally divided into visual and audible metronomes and in most cases the metronome is capable of operating in either or both of these modes. The most common metronome for a drummer to use includes a loud "click tone" (also called a "click track") such as a cowbell transmitted into an earpiece at a high, potentially dangerous decibel level. This on/off audible sound accurately transmits a set tempo but the sound level must be quite high to distinguish over the sound level of the band.

There are two common problems with the traditional "click track": Firstly, many musicians find themselves needing to turn the volume up very loud in order to hear the click consistently, which opens up the possibility for hearing damage. Secondly, it can be disconcerting—particularly for drummers—that when playing in perfect synchronicity, the click tone can seem to disappear and be difficult to pinpoint.

There are a number of visual based metronomes which vary from a pulsing LED which is turned on and off in time with the tempo, to more sophisticated visual displays which attempt to impart significantly more information than merely the tempo. For example, a progressing graph is used to display an upbeat and a downbeat, and to also provide a visual representation of the time interval remaining before the next beat. These prior art visual display metronomes have not proven as effective in communicating the tempo information to the user without a relatively high level of concentration.

A predominantly visual metronome offers some key advantages. Firstly, the musician can concentrate on the music being produced without audible interference from the metronome. Secondly, there is no decrease in perception of the tempo when a musician is playing along in perfect synchronicity (unlike the audible click track which can "disappear" when the musician is playing in perfect time). Lastly, the musician has greater flexibility in that he or she can effectively receive tempo information only when desired. For example, the musician can look away from or willfully ignore the visual signal, effectively using it on as-needed basis. In contrast it is extremely difficult, if not impossible, to willfully ignore an audio based metronome.

The present invention provides an improved visual metronome that transmits the tempo information in an accurate and effective manner.

SUMMARY OF THE INVENTION

A device for producing a visual tempo according to the present invention comprises means for selecting a specific tempo, a tempo display having at least two visual states with each visual state having at least three distinct regions, and the visual states changing as a function of the specific tempo. The regions cooperate whereby a change from one visual state to a different visual state causes a distinct visual change in at least 40% of the tempo display.

According to a preferred aspect of the invention, the location and size of the regions of each visual state are generally the same.

In yet a further aspect of the invention, at least two of the regions change visual color during each visual state change.

A device for producing a visual tempo in a different aspect of the invention comprises means for selecting a specific tempo, a tempo display, and means for producing two visual states where each visual state has a similar dominant pattern. The dominant pattern has four regions positioned about a center point such that each region is adjacent two other regions and each region is visually distinct from adjacent regions. The visual states are alternately displayed on the tempo display in accordance with the specific tempo, and each region of the dominant pattern visually changes with each change in visual state.

According to an aspect of the invention, the dominant pattern in the visual states are inversely related.

In yet a further aspect of the invention, the four regions are spaced about an origin having orthogonal axis defining four quadrants, and each region is positioned in one of the quadrants.

In yet a further aspect of the invention, each region generally corresponds to a quadrant of the tempo display.

In yet a further aspect of the invention, each visual state is displayed for one beat of the tempo. Preferably the tempo display is at least five square centimeters in size.

In a different aspect of the invention, the device for setting the tempo comprises means for inputting a desired tempo, a display arrangement for alternately displaying a dominant pattern having at least three regions, and at least two of the regions change visual state with each beat of the tempo. The regions of the dominant pattern are radially positioned about a center point.

In a preferred aspect of this device, the regions are located about the center point and cooperate such that each change in visual state produces a change in at least two quadrants defined by orthogonal axis through the center point.

In a preferred aspect of the invention, the visual state of the regions alternate and invert across two axis through the center point. Preferably the dominant pattern is a checker board pattern.

The visual states in the alternating check board pattern are found to be passively jarring to a user. The alternating displays are quite effective in transferring tempo information without significant concentration. It has been found that the device may be placed such that the visual display is positioned in what would normally be the user's peripheral vision and the alternating dominant pattern passively provides an excellent reference of the particular tempo. This transferred information is accommodated in a manner allowing the user to effectively turn if off by merely looking away from the display. The user can also look directly at the display when he is initially trying to set the tempo. The alternating visual display in a user's peripheral vision allows communication of the tempo without overloading of this sensory input.

BRIEF DESCRIPTION OF THE DRAWINGS

Preferred embodiments of the invention are shown in the drawings, wherein.

DETAILED DESCRIPTION OF THE PREFERRED EMBODIMENTS

Figures 1, 2, 3:
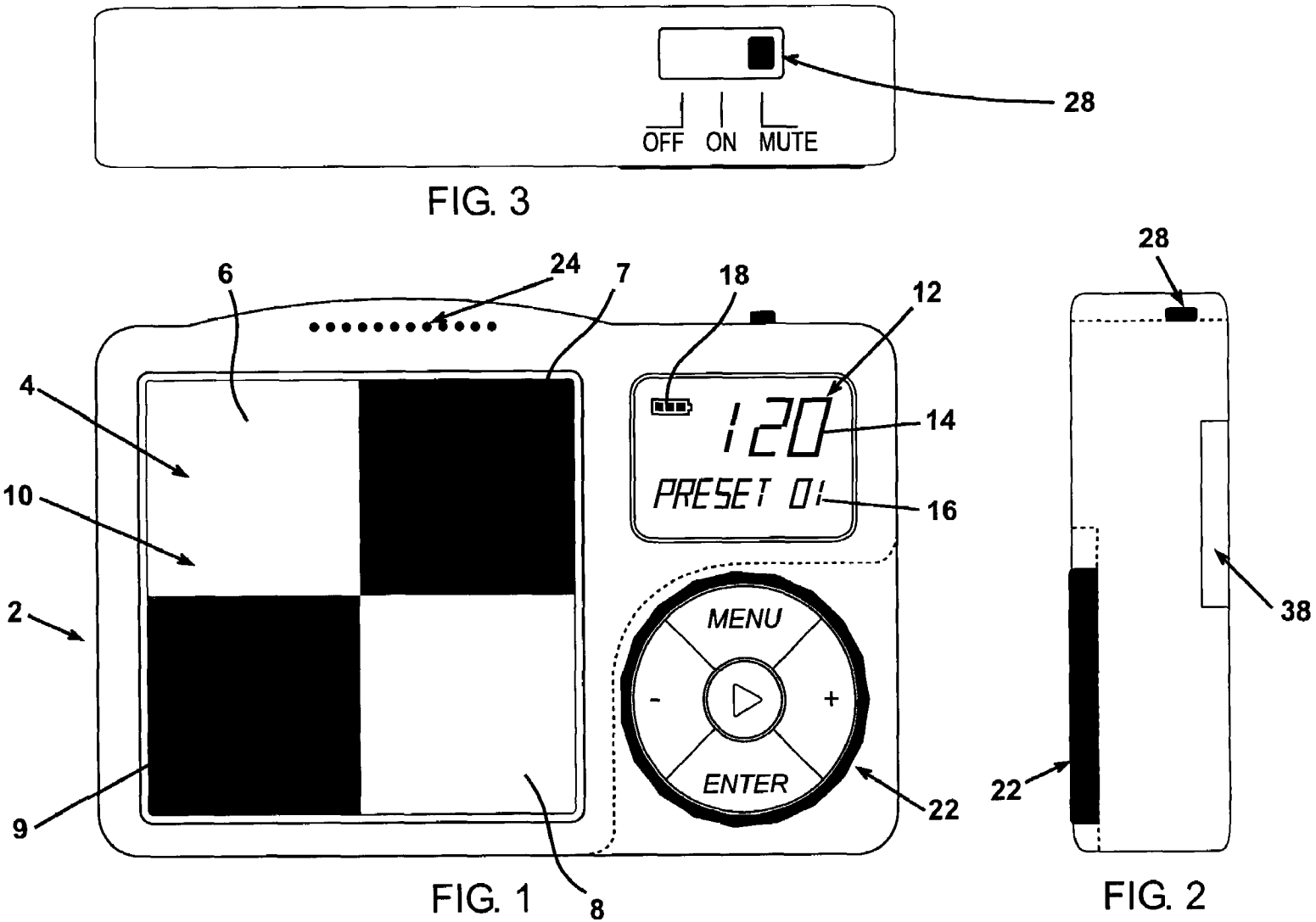
FIG. 1 is a front view of the device for producing a visual tempo.
FIG. 2 is a left end view of the device of FIG. 1.
FIG. 3 is a top view of the device of FIG. 1.

The metronome 2 shown in FIGS. 1 through 5 includes a relatively large tempo display 4 which is divided into regions 6, 7, 8 and 9 to form the dominant pattern indicated as 10. In the dominant pattern, the regions on opposite sides of the vertical axis are inversely related and the regions on either side of the horizontal axis are inversely related. Preferably this white and black checkerboard pattern is alternated with each beat. This is basically shown in the two visual states shown in FIGS. 6 and 7 and FIGS. 10 and 11.

The metronome 2 includes a secondary display 12 which includes an indication of the user-set beats per minute at item 14 as well as a song, name or other alphanumeric description provided at 16. Also, the secondary display 12 preferably includes a battery level indicator 18.

A user control 22 is provided and allows the user to access a menu to change various items of the tempo display 4 and/or the secondary display 12. This control allows the user to vary the tempo indicated as beats per minute 14 which is currently shown as a 120 beats per minute. The user can program the device to have a number of preset beats per minute and these can be associated with a song list if desired. For example, it is often valuable for a person in a band to use the metronome and have an indication of the actual beats per minute of the particular song as well as the title of the song. All of these can be displayed on the secondary display 12 or part of a larger display such as on the PDA device shown in FIGS. 6 and 7.

The metronome 2 also includes a selector switch 28 which turns the device on and off and also allows the device to be used solely in a visual mode indicated as the mute switch position 28. A combination audio and visual position is provided by the ON position of switch 28 and the device is turned OFF by moving the switch to the OFF position. It is also possible to have this switch merely provide a pure audio position or different visual positions. The circuitry provided in the device allows outputting of an audio signal such as a drum beat signal, cowbell signal or other appropriate signal, and a speaker is provided behind the ports 24 to transmit the audible signal.

Figure 4:
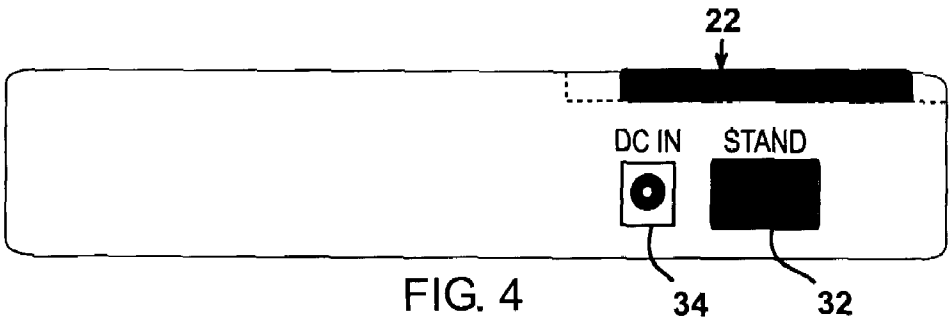
FIG. 4 is a bottom view of the device of FIG. 1.
Figure 5:
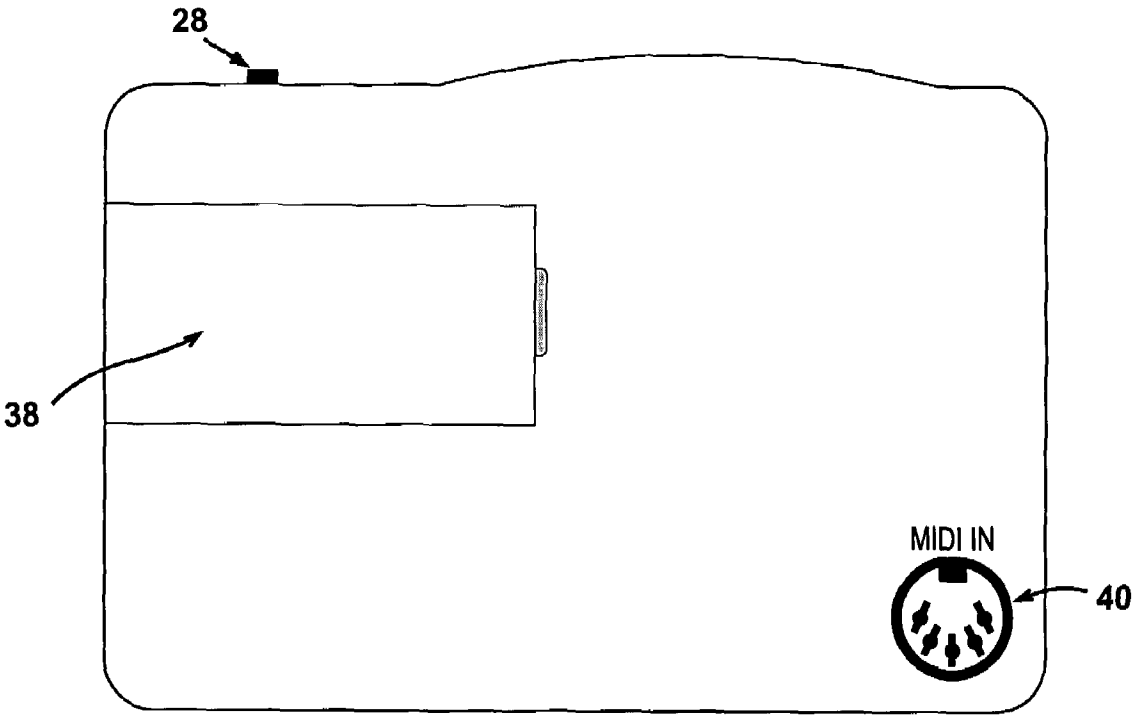
FIG. 5 is a rear view of the device of FIG. 1.

The bottom view of FIG. 4 shows a suitable stand connector 32 for securing the device to a music stand or support in close proximity to a musician. In addition, there is a DC charger connection 34 to allow recharging of the batteries of the device. Replaceable batteries can be provided behind the battery cover 38. The device preferably includes a MIDI IN connector 40 to allow synchronized connection with other equipment. This is particularly helpful for musicians in a band where there may be a primary device which is effectively controlling other devices and it can control the visual display of the metronome through the MIDI IN connector 40. This feature can be used by a band member or sound engineer to ensure synchronization with synthesizers and digital recording equipment. Two or more metronomes can be connected to the same master timekeeping device.

Figure 7:
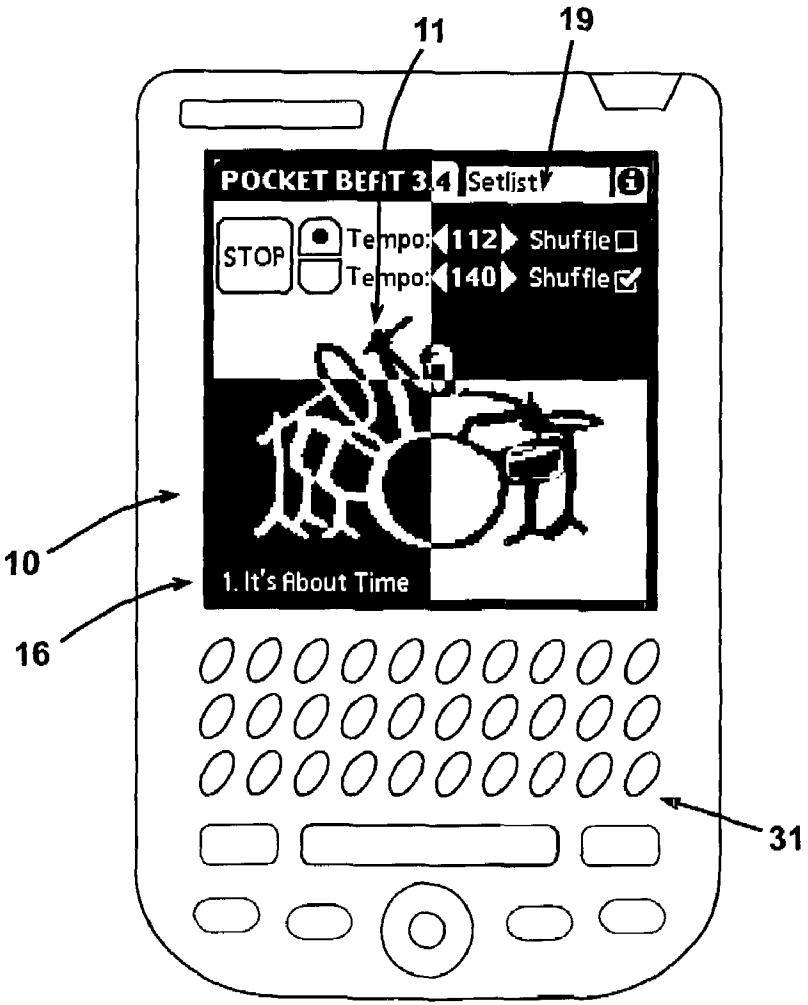
FIG. 7 is a view similar to FIG. 6 with an alternate dominant pattern shown.
Figure 6:
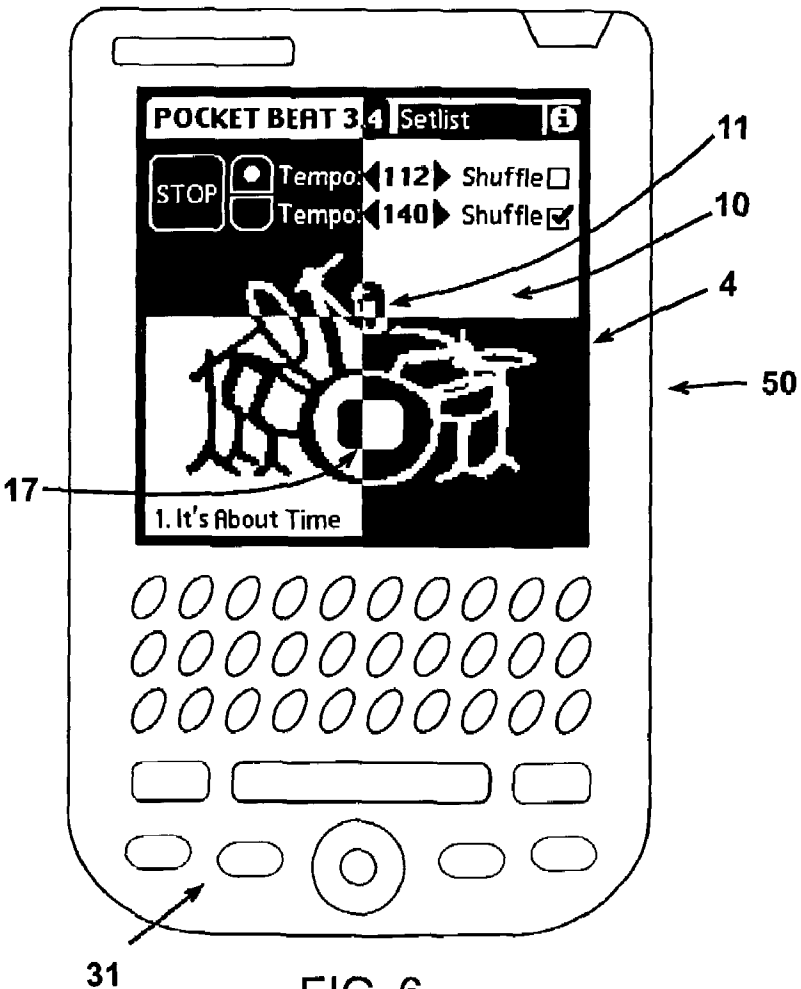
FIG. 6 is a front view of an alternate embodiment of the invention where the metronome is provided as part of a PDA device.

The tempo display 4 is preferably at least 50 mm by 50 mm and is typically less than 160 mm by 160 mm. The display is capable of displaying the two highly contrasting visual states as shown in FIGS. 6 and 7. These are preferably black and white and the visual states are preferably held for the duration of each beat. On the next beat, the visual states alternate and it can be seen that the color of the dominant pattern alternates across both the vertical axis of the tempo display as well as the horizontal axis of the tempo display. This particular combination is easily recognized in a user's peripheral vision and has been found to effectively transfer the tempo information without interrupting the user.

Figure 11:
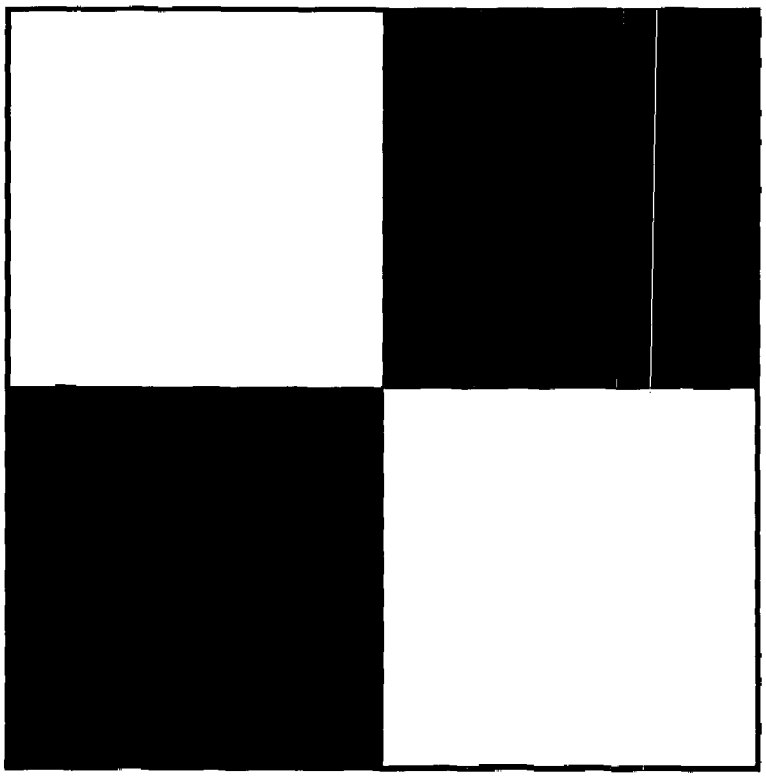
FIGS. 10 and 11 show the two states of the preferred dominant pattern and FIGS. 12, 13, 14 and 15 show an alternate dominant pattern.
Figure 10:
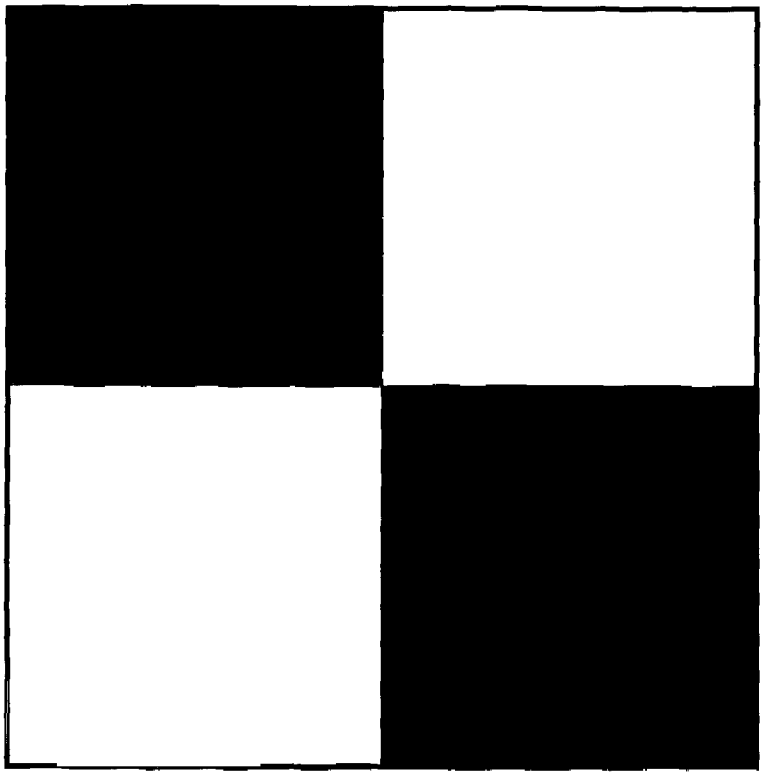

Preferably the tempo display is a bright, high contrast matrix display such as that found on the Palm III™ PDA, Palm Tungsten™ C PDA, or other similar devices. The device includes at least two different visual states indicated in FIGS. 6 and 7 having the dominant pattern defined by the checkerboard pattern. These visual states of the dominant pattern are also shown in FIGS. 10 and 11.

In FIGS. 6 and 7 a secondary pattern including a representation of a drummer 11 and drum set up, is shown superimposed on the dominant pattern 10. In this embodiment, the secondary pattern also alternates as a function of the tempo. Even with the secondary pattern superimposed on the dominant pattern, the collective effect is still achieved and the visual transfer of the tempo information is effectively communicated to the user. The black and white pattern is preferred but other color combinations can be used.

In the embodiments shown in FIGS. 6 and 7, the metronome is shown as part of a generic PDA device 50. It is preferred that a separate dedicated metronome be provided such as the device shown in FIGS. 1 through 5, however, it is possible to use the relatively large display of a PDA type device and appropriately program the device to act as previously described. Preferably, a set list 19 is provided to assist the musician. In these alternate embodiments, it can be seen that the tempo display can also include additional information on the dominant pattern while still allowing the dominant pattern to transfer the tempo information. For example, in FIG. 6, the bass drum is divided into white and black regions which are reversed, relative to FIG. 7. In addition, FIG. 6 includes the inset square 17 that is not present in FIG. 7. This arrangement further communicates the tempo information by effectively providing an ON/OFF signal.

With the embodiments in FIGS. 6 and 7, a separate arrangement can be provided for mounting of the PDA device in a suitable manner for a musician. It is desired that the metronome be placed in an appropriate location for the particular musician such as a drummer, and typically, this will be offset from his normal center of vision while still being recognizable in his peripheral vision. It has been found that this device when used on a display screen of a size generally corresponding with a PDA device, that the device need not be that close to a user and can be at least several meters away. As can be appreciated the distinction between PDA devices, MP3 Players and cell phones continues to diminish and the relatively large display of any personal electronics device could be used in this manner.

The alternating dominant display produces an easily recognized visual movement on the screen that is discernable in the user's peripheral vision. The preferred images alternate in an inverse fashion and the patterns desirably cover most of the high contrast display area.

With the metronome set at 60 beats per minute, and with the metronome set by default to change visual and/or audible state with each beat, the display area would display the image in FIG. 1 followed one second later by the inverse of this image. One second later the original image of FIG. 1 would be displayed.

The user control 22 allows the user to enter a tempo into the metronome and be displayed on the secondary display 12. In the dedicated device, the user control 22 includes effectively five ON/OFF control switches with each switch associated with one of the items identified as "menu", the item identified by the "+" sign, the item identified by "enter", the item identified by the "–" sign as well as the triangle central switch. Other arrangements are possible but this provides a simple interface for controlling of the dedicated metronome.

In the alternate embodiment of FIGS. 6 and 7, on-screen controls and various control actuators 31 can be used for adjusting the display and entering of the required information. The alternating dominant patterns 10 are shown in FIGS. 10 and 11.

Figure 9:
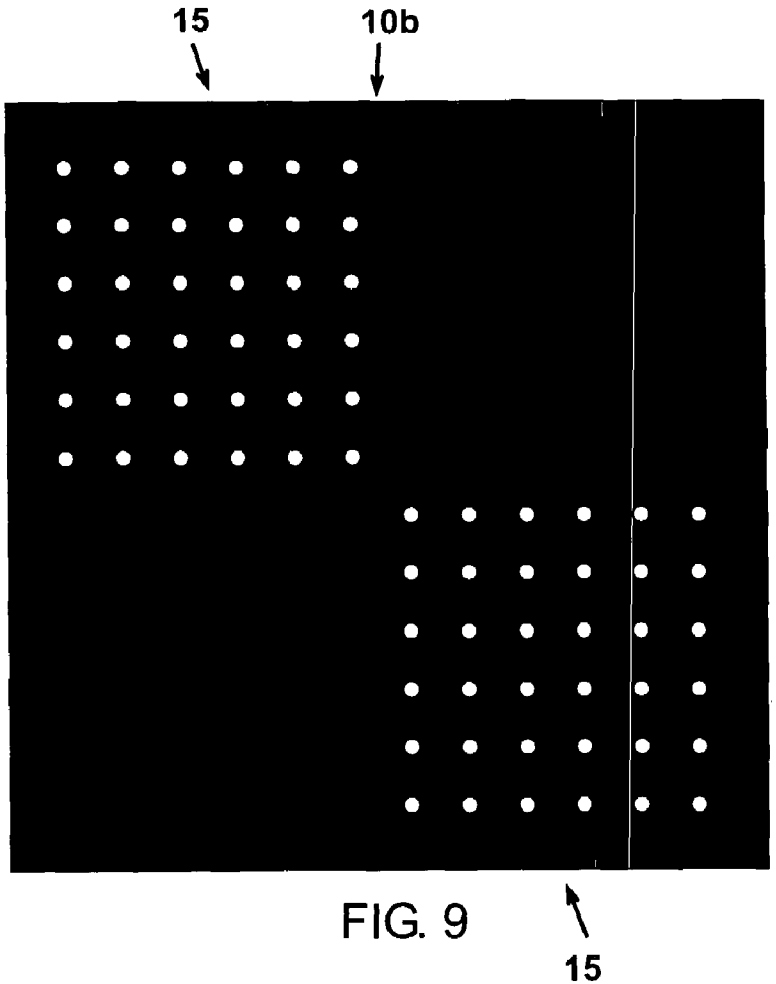
FIGS. 8 and 9 illustrate the two states of an alternate tempo display screen that can be used.
Figure 8:
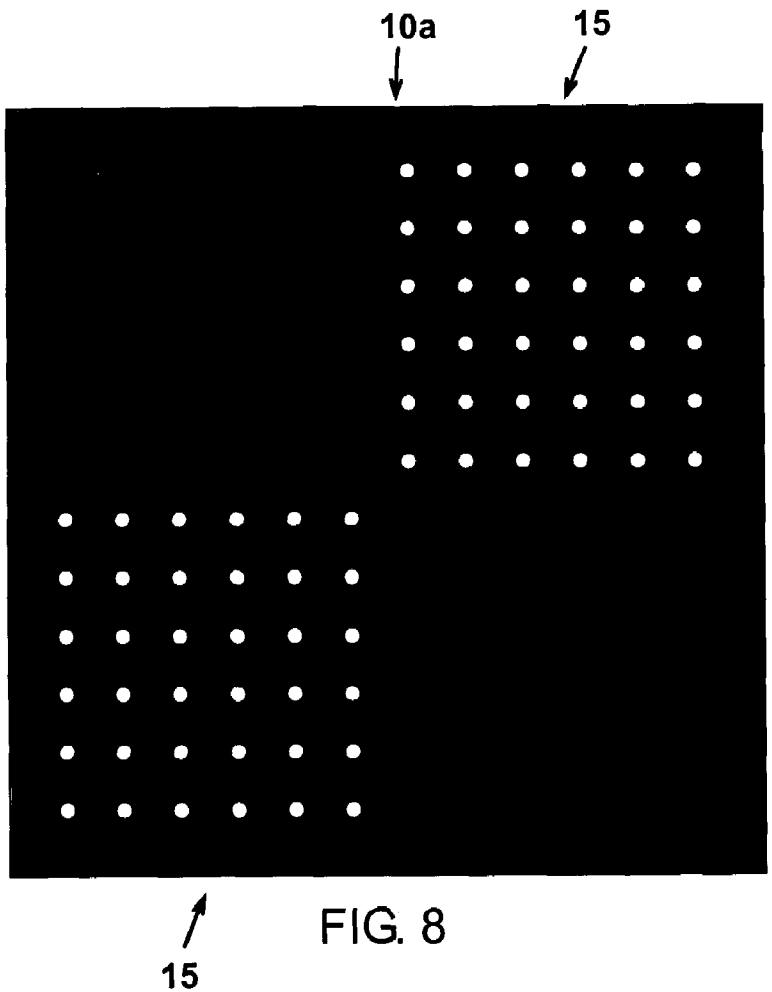

FIGS. 8 and 9 illustrate a variation of the dominant pattern. In this case, the dominant patterns 10*a* and 10*b* (the reverse of 10A) are shown with a black background with diagonally opposed alternating squares 15 defined by a grid of white dots. This pattern may be more easily produced in some devices.

Figure 13:
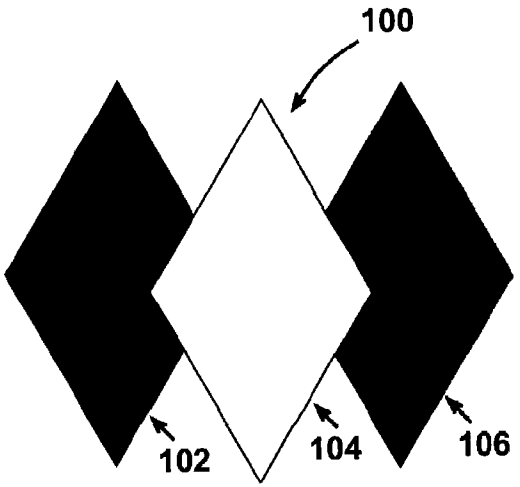
Figure 12:
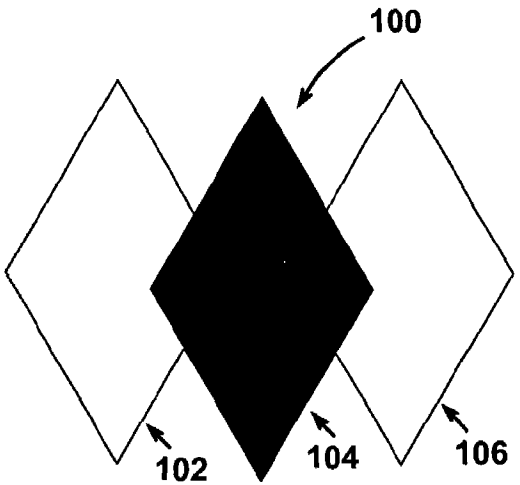
Figure 15:
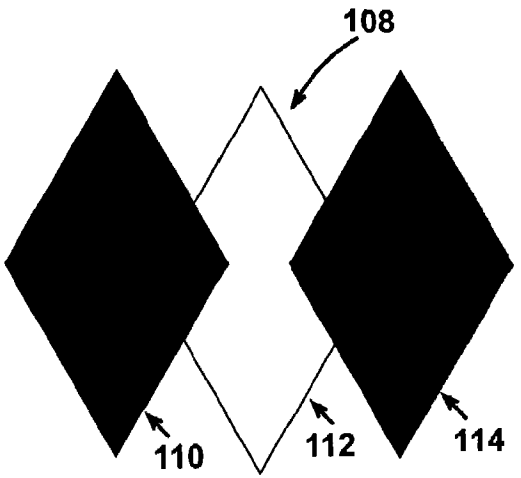
Figure 14:
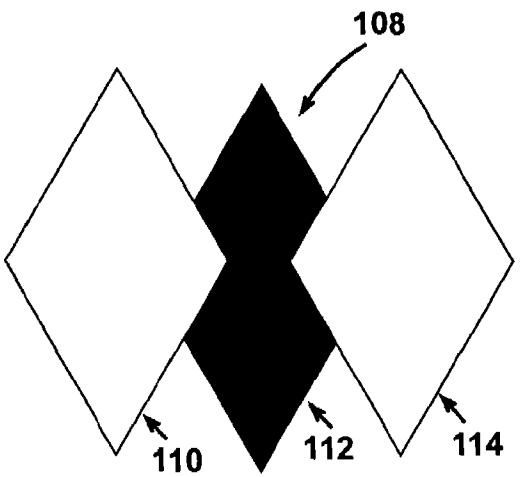

The alternate dominant pattern of FIGS. 12, 13, 14 and 15 includes the pattern 100 in FIGS. 12 and 13 which are reverse visual states. The pattern 100 includes three diamond regions 102, 104 and 106 that reverse color between FIGS. 12 and 13. FIGS. 14 and 15 use pattern 108 having diamond regions 110, 112 and 114. In contrast to pattern 100, pattern 108 has the center region 112 behind superimposed regions 110 and 114. Each pattern 100 and 102 change visual states and essentially 4 visual states are shown. Adjacent regions change color with each division of the tempo. This arrangement is useful in providing a 4 beat repeating sequence for example.

It is also desirable to be able to store a list of tempos related to musical pieces associated with a given performance, often referred to as a set list. It is then desirable to allow the user to progress through the set list in a simplified manner. With the arrangement as shown in FIG. 1, the set list can include various titles which will be displayed at item 16 as well as the various tempos displayed at 14. The user can progress from one song to the next song by pressing the "+" indicator on the control switch 22. Tempo can also be changed at any time whenever an external device is plugged into the MIDI IN connector 40.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive priority or privilege is claimed are defined as follows:

1. A device for producing a visual tempo comprising means for selecting a specific tempo, a tempo display, means for producing two visual states where each visual state has a similar dominant pattern, said dominant pattern having 4 regions positioned about a center point such that each region is adjacent two other regions and each region is visually distinct from adjacent regions, said visual states being alternately displayed on said tempo display in accordance with the specific tempo and each region of the dominant pattern visually changing with each change in visual state.

2. A device as claimed in claim 1 wherein the dominant pattern in said visual states are inversely related.

3. A device as claimed in claim 1 wherein said 4 regions are spaced about an origin having orthogonal axes defining 4 quadrants and each region is positioned in one of said quadrants.

4. A device as claimed in claim 3 wherein each region generally corresponds to a quadrant of the tempo display.

5. A device as claimed in claim 1 wherein each visual state is displayed for one beat of said tempo.

6. A device as claimed in claim 1 wherein said tempo display is at least 5 square centimeters in size.

7. A device for setting a tempo comprising means for inputting a desired tempo, a display arrangement for alternately displaying a dominant pattern having at least three regions, said at least 3 regions being adjacent with adjacent regions being visually distinguishable therebetween and at least two of the regions change visual state with each beat of the tempo, and wherein said regions of said dominant pattern are radially positioned about a center point and said regions are located about said center point and cooperate such that each change in visual state produces a change in at least two quadrants defined by orthogonal axes through said center point.

8. A device as claimed in claim 7 wherein said at least three regions are four regions.

9. A device as claimed in claim 8 wherein said four regions are each located in a different quadrant.

10. A device as claimed in claim 9 wherein each region generally defines a quadrant.

11. A device as claimed in claim 7 wherein the visual state of said regions alternate and invert across two axes through said canter point.

12. A device as claimed in claim 11 wherein said dominant pattern is a checker board pattern.

13. A device as claimed in claim 12 wherein said checker board pattern is a white/black pattern.

14. A device as claimed In claim 7 wherein said dominant pattern alternates between two inversely related visual states of the dominant pattern.

15. A device as claimed in claim 7 wherein said tempo is defined by beats and said dominant pattern alternates visual states with each beat.

16. A device as claimed in claim 15 wherein said dominant pattern is maintained on said tempo display until the next beat.

17. A device as claimed in claim 7 wherein said visual states are passively jarring to the user.

* * * * *